US006468030B2

(12) United States Patent
Kawasaki

(10) Patent No.: US 6,468,030 B2
(45) Date of Patent: Oct. 22, 2002

(54) TURBO-MOLECULAR PUMP

(75) Inventor: Hiroyuki Kawasaki, Chigasaki (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/883,927

(22) Filed: Jun. 20, 2001

(65) Prior Publication Data

US 2001/0055526 A1 Dec. 27, 2001

(30) Foreign Application Priority Data

Jun. 23, 2000 (JP) ..... 2000-189949

(51) Int. Cl.[7] ..... F04D 19/04
(52) U.S. Cl. ..... 415/90
(58) Field of Search ..... 415/90, 199.1, 415/199.2, 199.3, 199.4, 199.5, 199.6

(56) References Cited

U.S. PATENT DOCUMENTS

| | | | | |
|---|---|---|---|---|
| 4,893,985 A | | 1/1990 | Hölss | |
| 5,033,936 A | | 7/1991 | Shinojima | |
| 5,456,575 A | | 10/1995 | Helmer et al. | |
| 5,618,167 A | * | 4/1997 | Hirakawa et al. | 417/372 |
| 5,688,106 A | * | 11/1997 | Cerruti et al. | 415/90 |
| 5,695,316 A | * | 12/1997 | Schutz et al. | 415/90 |
| 6,062,810 A | * | 5/2000 | Miyamoto et al. | 415/90 |

FOREIGN PATENT DOCUMENTS

| | | |
|---|---|---|
| DE | 297 15 035 U1 | 10/1997 |
| EP | 0 770 781 | 5/1997 |
| EP | 0 965 761 A2 | 12/1999 |
| EP | 0 967 395 | 12/1999 |
| EP | 1 039 137 A2 | 9/2000 |
| FR | 2191626 | 1/1994 |

OTHER PUBLICATIONS

Copy of European Patent Office Communication for corresponding European Patent Application No. 01115176.8–2315 including European Search Report dated Oct. 10, 2001.

* cited by examiner

*Primary Examiner*—Edward K. Look
*Assistant Examiner*—Ninh Nguyen
(74) *Attorney, Agent, or Firm*—Armstrong, Westerman & Hattori, LLP

(57) ABSTRACT

A turbo-molecular pump evacuates gas with a rotor that rotates at a high speed. The turbo-molecular pump comprises a casing, a stator fixedly mounted in the casing and having stator blades, a rotor rotatably provided in the casing and having rotor blades alternating with the stator blades, and a radial turbine blade pumping section having a spiral ridge-groove section provided on at least one of surfaces, facing each other, of the stator blade and the rotor blade. At least one of the stator blade and the rotor blade which are located at a first stage of the radial turbine blade pumping section has such a shape that at least one of the stator blade and the rotor blade is smaller in thickness in a direction of gas flow.

8 Claims, 14 Drawing Sheets

TURBO-MOLECULAR PUMP

BACKGROUND OF THE INVENTION

1. Field of the Invention

The present invention relates to a turbo-molecular pump for evacuating gas with a rotor that rotates at a high speed, and more particularly to a turbo-molecular pump having a radial turbine blade pumping section in a casing.

2. Description of the Related Art

FIG. 12 of the accompanying drawings shows a conventional turbo-molecular pump having a radial turbine blade pumping section in a casing. As shown in FIG. 12, the conventional turbo-molecular pump comprises a rotor R and a stator S which are housed in a casing 10. The rotor R and the stator S jointly make up an axial turbine blade pumping section $L_1$ and a radial turbine blade pumping section $L_2$. The stator S comprises a base 14, a stationary cylindrical sleeve 16 vertically mounted centrally on the base 14, and stationary components of the axial turbine blade pumping section $L_1$ and the radial turbine blade pumping section $L_2$. The rotor R comprises a main shaft 18 inserted in the stationary cylindrical sleeve 16, and a rotor body 20 fixed to the main shaft 18.

Between the main shaft 18 and the stationary cylindrical sleeve 16, there are provided a drive motor 22, and upper and lower radial bearings 24 and 26 provided above and below the drive motor 22. An axial bearing 28 is disposed at a lower portion of the main shaft 10, and comprises a target disk 28*a* mounted on the lower end of the main shaft 18, and upper and lower electromagnets 28*b* provided on the stator side. Further, touchdown bearings 29*a* and 29*b* are provided at upper and lower portions of the stationary cylindrical sleeve 16.

With this arrangement, the rotor R can be rotated at a high speed under 5-axis active control. The rotor body 20 in the axial turbine blade pumping section $L_1$ has disk-like rotor blades 30 integrally provided on an upper outer circumferential portion thereof. In the casing 10, there are provided stator blades 32 disposed axially alternately with the rotor blades 30. Each of the stator blades 32 has an outer edge clamped by stator blade spacers 34 and is thus fixed. Each of the rotor blades 30 has a wheel-like configuration which has a hub at an inner circumferential portion thereof, a frame at an outer circumferential portion thereof, and inclined blades (not shown) provided between the hub and the frame and extending in a radial direction. Thus, the turbine blades 30 are rotated at a high speed to make an impact on gas molecules in an axial direction for thereby evacuating gas.

The radial turbine blade pumping section $L_2$ is provided downstream of, i.e. below the axial turbine blade pumping section $L_1$. In the radial turbine blade pumping section $L_2$, the rotor body 20 has disk-like rotor blades 36 integrally provided on an outer circumferential portion thereof in the same manner as the axial turbine blade pumping section $L_1$. In the casing 10, there are provided stator blades 38 disposed axially alternately with the rotor blades 36. Each of the stator blades 38 has an outer edge clamped by stator blade spacers 40 and is thus fixed.

Each of the stator blades 38 is in the form of a follow disk, and as shown in FIGS. 13A and 13B, each of the stator blades 38 has spiral ridges 46 which are formed in the front and backside surfaces thereof and extend between a central hole 42 and an outer circumferential portion 44, and spiral grooves 48 whose widths are gradually broader radially outwardly and which are formed between the adjacent ridges 46. The spiral ridges 46 on the front surface, i.e. upper surface of the stator blade 38 are configured such that when the rotor blade 36 is rotated in a direction shown by an arrow A in FIG. 13A, gas molecules flow inwardly as shown by a solid line arrow B. On the other hand, the spiral ridges 46 on the backside surface, i.e. lower surface of the stator blade 38 are configured such that when the rotor blade 36 is rotated in a direction shown by the arrow A in FIG. 13A, gas molecules flow outwardly as shown by a dotted line arrow C. Each of the stator blade 38 is usually composed of two half segments, or three or more divided segments. The stator blades 38 are assembled by interposing the stator blade spacers 40 so that the stator blades 38 alternate with the rotor blades 36, and then the completed assembly is inserted into the casing 10.

With the above configuration, in the radial turbine blade pumping section $L_2$, a long evacuation passage extending in zigzag from top to bottom between the stator blades 38 and the rotor blades 36 is constructed within a short span in the axial direction, thus achieving high evacuation and compression performance without making the radial turbine blade pumping section $L_2$ long in the axial direction.

In the radial turbine blade pumping section $L_2$, the outer diameter $D_1$ of the rotor at its portion facing the inner circumferential surface of the stator blade 38 is set to the same dimension in all stages, and the inner diameter $D_2$ of the stator (outer diameter of the spiral ridge-groove section) at its portion facing the outer circumferential surface of the rotor blade 36 is set to the same dimension in all stages.

However, in the case of the conventional turbo-molecular pump having the radial turbine blade pumping section $L_2$, as shown in FIG. 14, the gap $G_1$ between the stator blade 38 located at the first stage in the radial turbine blade pumping section $L_2$ and the rotor blade 30 located immediately above this first-stage stator blade 38 and at the lowermost stage in the axial turbine blade pumping section $L_1$ is constant. Therefore, the cross-sectional area of the flow passage extending along the upper surface of the stator blade 38 toward the inner circumferential side of the stator blade 38, i.e. the inner circumferential side of the radial turbine blade pumping section $L_2$ decreases drastically in proportion to the radius of the stator blade 38. Consequently, the gas is prevented from flowing smoothly to the inner circumferential side of the radial turbine blade pumping section $L_2$ to cause stagnation of the gas. Further, when the gas turns its flow direction from the axial direction to the radial direction, the gas cannot be smoothly flowed to be stagnated, thus lowering the evacuation performance of the pump.

SUMMARY OF THE INVENTION

The present invention has been made in view of the above drawbacks in the conventional turbo-molecular pump. It is therefore an object of the present invention to provide a turbo-molecular pump which can create smooth gas flow therein and prevent the evacuation performance from lowering.

According to a first aspect of the present invention, there is provided a turbo-molecular pump comprising: a casing; a stator fixedly mounted in the casing and having stator blades; a rotor rotatably provided in the casing and having rotor blades, the rotor blades alternating with the stator blades; and a radial turbine blade pumping section having a spiral ridge-groove section provided on at least one of surfaces, facing each other, of the stator blade and the rotor blade; wherein at least one of the stator blade and the rotor blade which are located at a first stage of the radial turbine blade pumping section has such a shape that the at least one of the stator blade and the rotor blade is smaller in thickness in a direction of gas flow.

With the above arrangement, at least one of the cross-sectional area of the flow passage defined between the stator blade at the first stage in the radial turbine blade pumping section and the rotor blade located immediately above this first-stage stator blade and at the lowermost stage in the axial turbine blade pumping section and the cross-sectional area of the flow passage defined between the rotor blade at the first stage in the radial turbine blade pumping section and the stator blade located immediately above this first-stage rotor blade and at the lowermost stage in the axial turbine blade pumping section is prevented from being drastically smaller in the direction of gas flow. Thus, the gas flowing from an upstream side into the radial turbine blade pumping section can be guided smoothly toward the inner circumferential side of the radial turbine blade pumping section.

According to a second aspect of the present invention, there is provided a turbo-molecular pump comprising: a casing; a stator fixedly mounted in the casing and having stator blades; a rotor rotatably provided in the casing and having rotor blades, the rotor blades alternating with the stator blades; and a radial turbine blade pumping section having a spiral ridge-groove section provided on at least one of surfaces, facing each other, of the stator blade and the rotor blade; wherein an outer diameter of the rotor at its portion facing an inner circumferential surface. of a stator blade at a first stage in the radial turbine blade pumping section is smaller than an outer diameter of the rotor at its portion facing an inner circumferential surface of a stator blade at any one of stages subsequent to the first stage.

With this arrangement, the cross-sectional area of the flow passage in an axial direction defined between the inner circumferential surface of the stator blade at the first stage and the outer circumferential surface of the rotor at its portion facing the inner circumferential surface of this first-stage stator blade is enlarged for thereby guiding the gas toward a radial direction in flow passages upstream and downstream of the flow passage in the axial direction.

According to a third aspect of the present invention, there is provided a turbo-molecular pump comprising: a casing; a stator fixedly mounted in the casing and having stator blades; a rotor rotatably provided in the casing and having rotor blades, the rotor blades alternating with the stator blades; and a radial turbine blade pumping section having a spiral ridge-groove section provided on at least one of surfaces, facing each other, of the stator blade and the rotor blade; wherein one of an inner diameter of the stator and an outer diameter of the spiral ridge-groove section at its portion facing an outer circumferential surface of a rotor blade at a first stage in the radial turbine blade pumping section is larger than an inner diameter of the stator and an outer diameter of the spiral ridge-groove section at its portion facing an outer circumferential surface of a rotor blade at any one of stages subsequent to the first stage.

With this arrangement, the cross-sectional area of the flow passage in an axial direction defined between the outer circumferential surface of the rotor blade at the first stage and the inner circumferential surface of the stator at its portion facing the outer circumferential surface of this first-stage rotor blade or the outer diameter of the spiral ridge-groove section is enlarged for thereby guiding the gas toward a radial direction in flow passages upstream and downstream of the flow passage in the axial direction. Generally, the inner circumferential surface of the stator at its portion facing the outer circumferential surface of this first-stage rotor blade and the outer diameter of the spiral ridge-groove section have the same dimension.

According to a fourth aspect of the present invention, there is provided a turbo-molecular pump comprising: a casing; a stator fixedly mounted in the casing and having stator blades; a rotor rotatably provided in the casing and having rotor blades, the rotor blades alternating with the stator blades; and a radial turbine blade pumping section having a spiral ridge-groove section provided on at least one of surfaces, facing each other, of the stator blade and the rotor blade; wherein an outer diameter of the rotor at its portion facing an inner circumferential surface of a stator blade at a first stage in the radial turbine blade pumping section is smaller than an outer diameter of the rotor at its portion facing an inner circumferential surface of a stator blade at any one of stages subsequent to the first stage; one of an inner diameter of the stator and an outer diameter of the spiral ridge-groove section at its portion facing an outer circumferential surface of a rotor blade at a first stage in the radial turbine blade pumping section is larger than an inner diameter of the stator and an outer diameter of the spiral ridge-groove section at its portion facing an outer circumferential surface of a rotor blade at any one of stages subsequent to the first stage.

The above and other objects, features, and advantages of the present invention will be apparent from the following description when taken in conjunction with the accompanying drawings which illustrates preferred embodiments of the present invention by way of example.

DETAILED DESCRIPTION OF THE PREFERRED EMBODIMENTS

Figure 12:
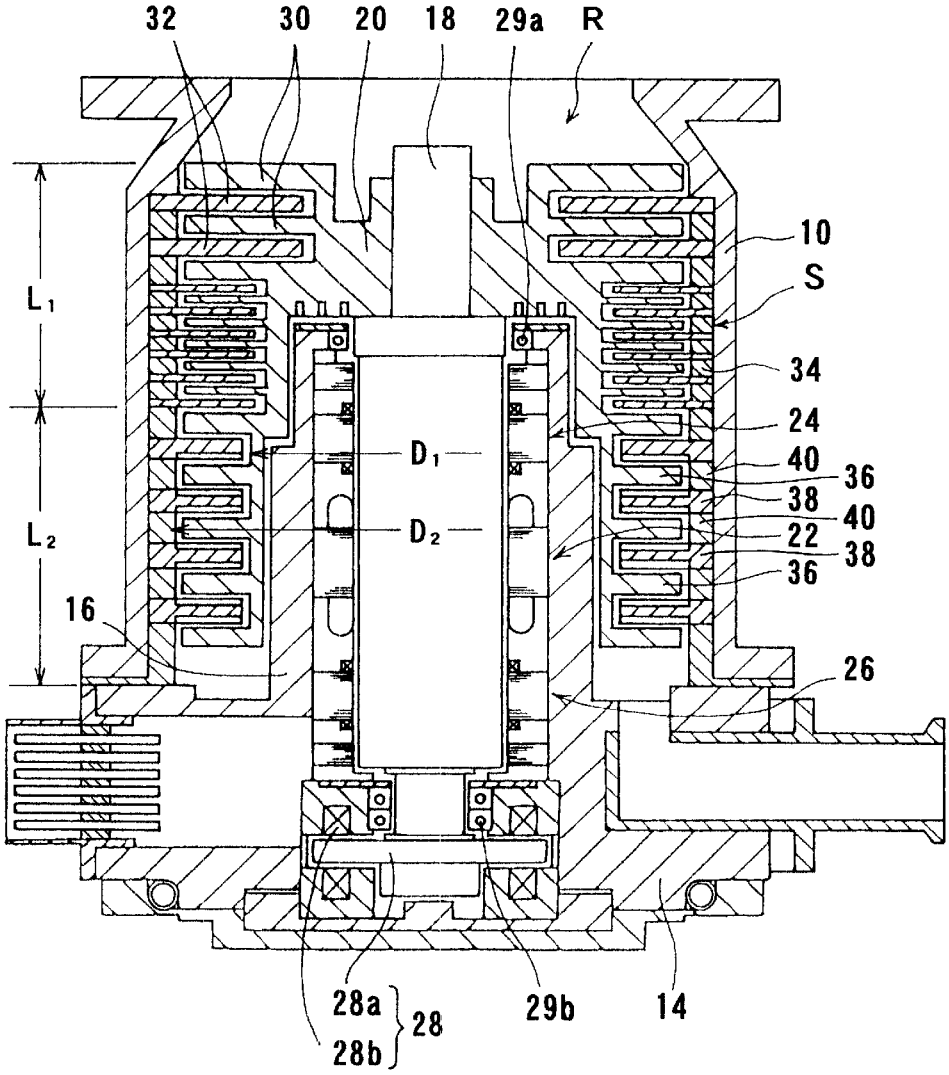
FIG. 12 is a cross-sectional view of a conventional turbo-molecular pump.
Figure 13A:
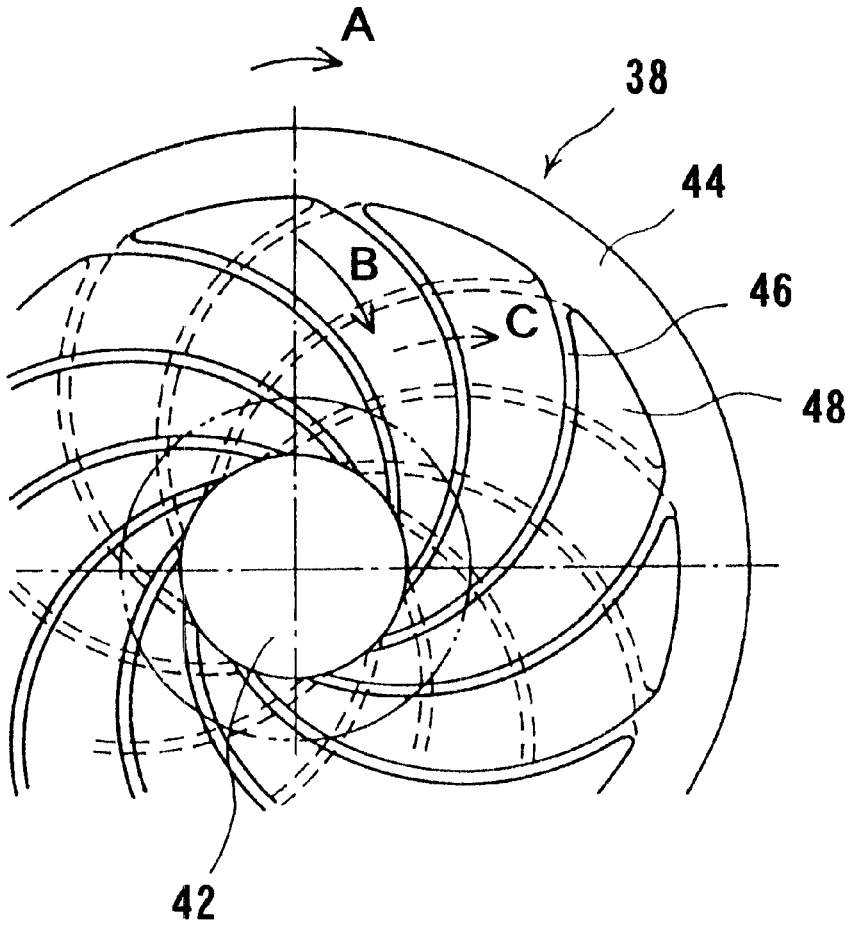
FIG. 13A is a plan view of a stator blade shown in FIG. 12.
Figure 13B:
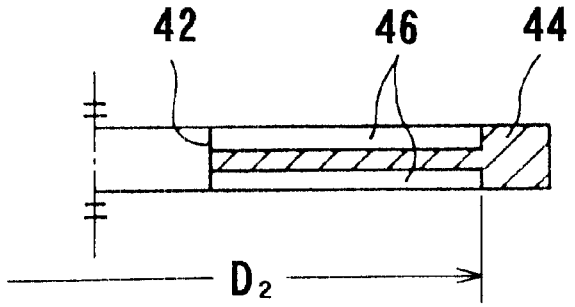
FIG. 13B is a cross-sectional view of the stator blade shown in FIG. 13A.
Figure 14:
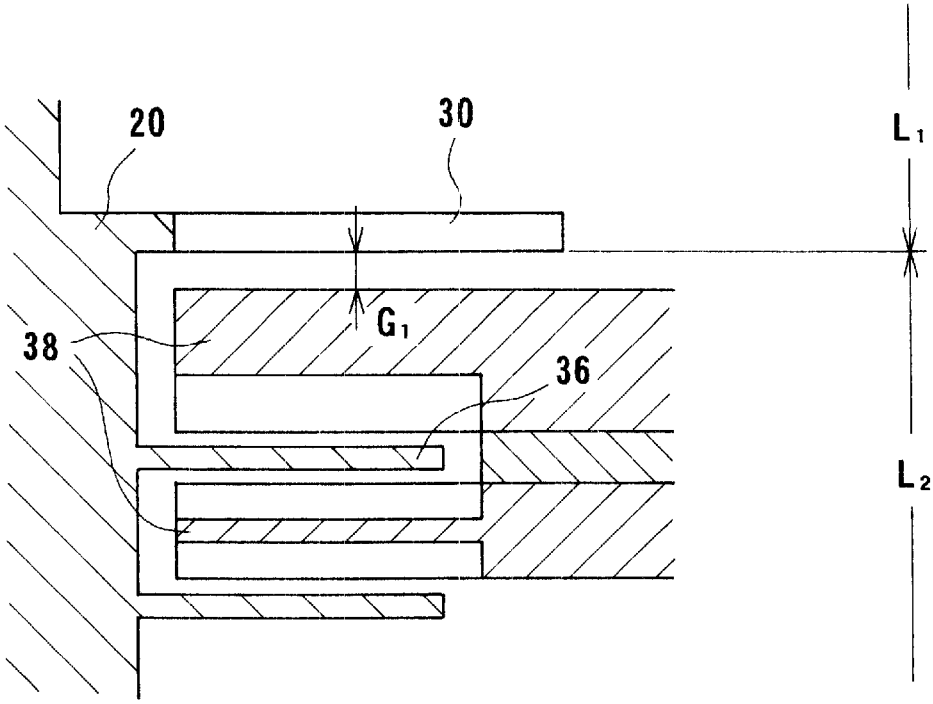
FIG. 14 is an enlarged view showing a part of the turbo-molecular pump shown in FIG. 12.

Next, turbo-molecular pumps according to embodiments of the present invention will be described below with reference to FIGS. 1 through 11. Like or corresponding parts are denoted by like or corresponding reference numerals throughout views. Those parts of turbo-molecular pumps according to the present invention which are identical to or correspond to those of the conventional turbo-molecular pump shown in FIGS. 12 through 14 are denoted by identical reference numerals, and will not be described in detail below.

Figure 1:
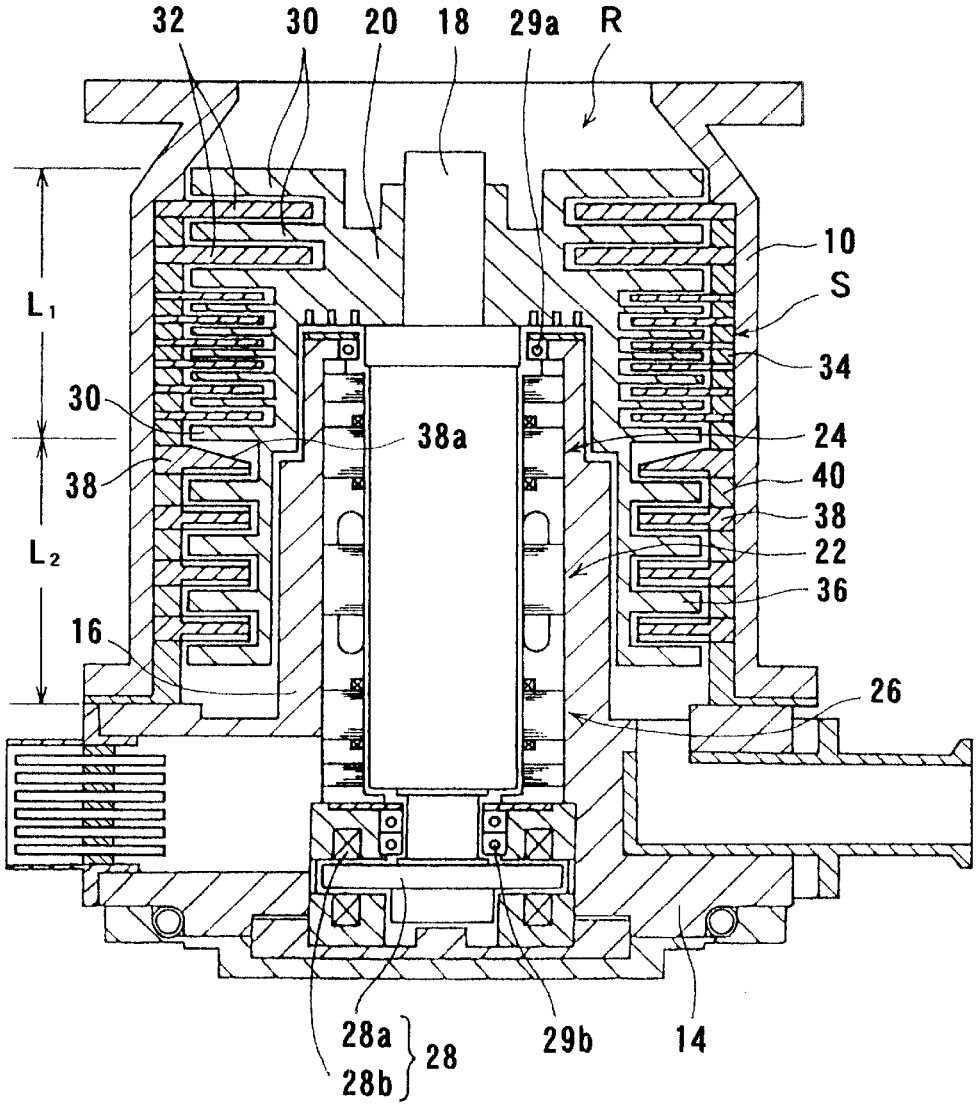
FIG. 1 is a cross-sectional view of a turbo-molecular pump according to a first embodiment of the present invention.
Figure 2:
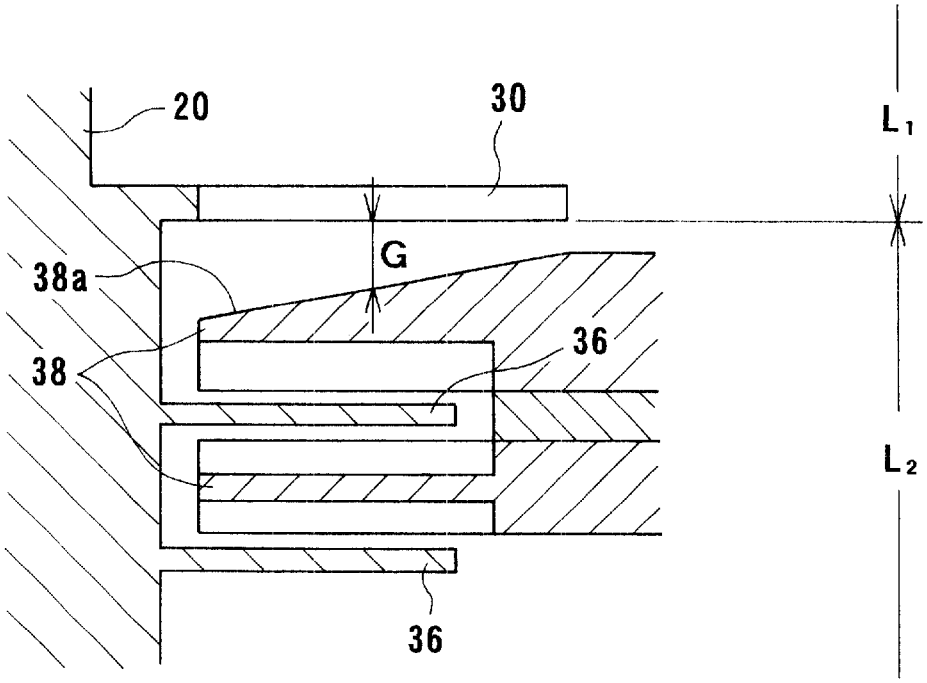
FIG. 2 is an essential part of the turbo-molecular pump shown in FIG. 1.

FIGS. 1 and 2 show a turbo-molecular pump according to a first embodiment of the present invention. In this embodiment, a turbo-molecular pump has an axial turbine blade pumping section $L_1$ and a radial turbine blade pumping section $L_2$ which comprise a turbine blade section, respectively, shown in FIGS. 12 through 14. As shown in FIGS. 1 and 2, the stator blade 38 at the first stage in the radial turbine blade pumping section $L_2$ has a tapered surface 38*a* which is gradually inclined downwardly in a radially inward direction to make the stator blade 38 gradually smaller in thickness so that the gap G between this first-stage stator blade 38 and the rotor blade 30 located immediately above the first-stage stator blade 38 and at the lowermost stage in the axial turbine blade pumping section $L_1$ is gradually larger toward the inner circumferential side of the stator blade 38, i.e. the inner circumferential side of the radial turbine blade pumping section $L_2$. Other details of the turbo-molecular pump according to the present embodiment are identical to those of the conventional turbo-molecular pump shown in FIGS. 12 through 14.

According to the present embodiment, the cross-sectional area of the flow passage defined between the stator blade 38 at the first stage in the radial turbine blade pumping section $L_2$ and the rotor blade 30 located immediately above this first-stage stator blade 38 and at the lowermost stage in the axial turbine blade pumping section $L_1$ is prevented from being gradually smaller in the direction of gas flow. Thus, the gas flowing from the axial turbine blade pumping section $L_1$ to the radial turbine blade pumping section $L_2$ can be guided smoothly toward the inner circumferential side of the radial turbine blade pumping section $L_2$.

In this embodiment, the stator blade 38 at the first stage has a thickness which is smaller toward a radially inward direction. However, the stator blade 38 at the first stage has such a shape as to be thinner in a step-like manner so that the gap G between this first-stage stator blade 38 and the rotor blade 30 located at the lowermost stage in the axial turbine blade pumping section $L_1$ is larger in the step-like manner. It is important that the cross-sectional area of the flow passage per unit length in the direction of gas flow is substantially the same.

Figure 3:
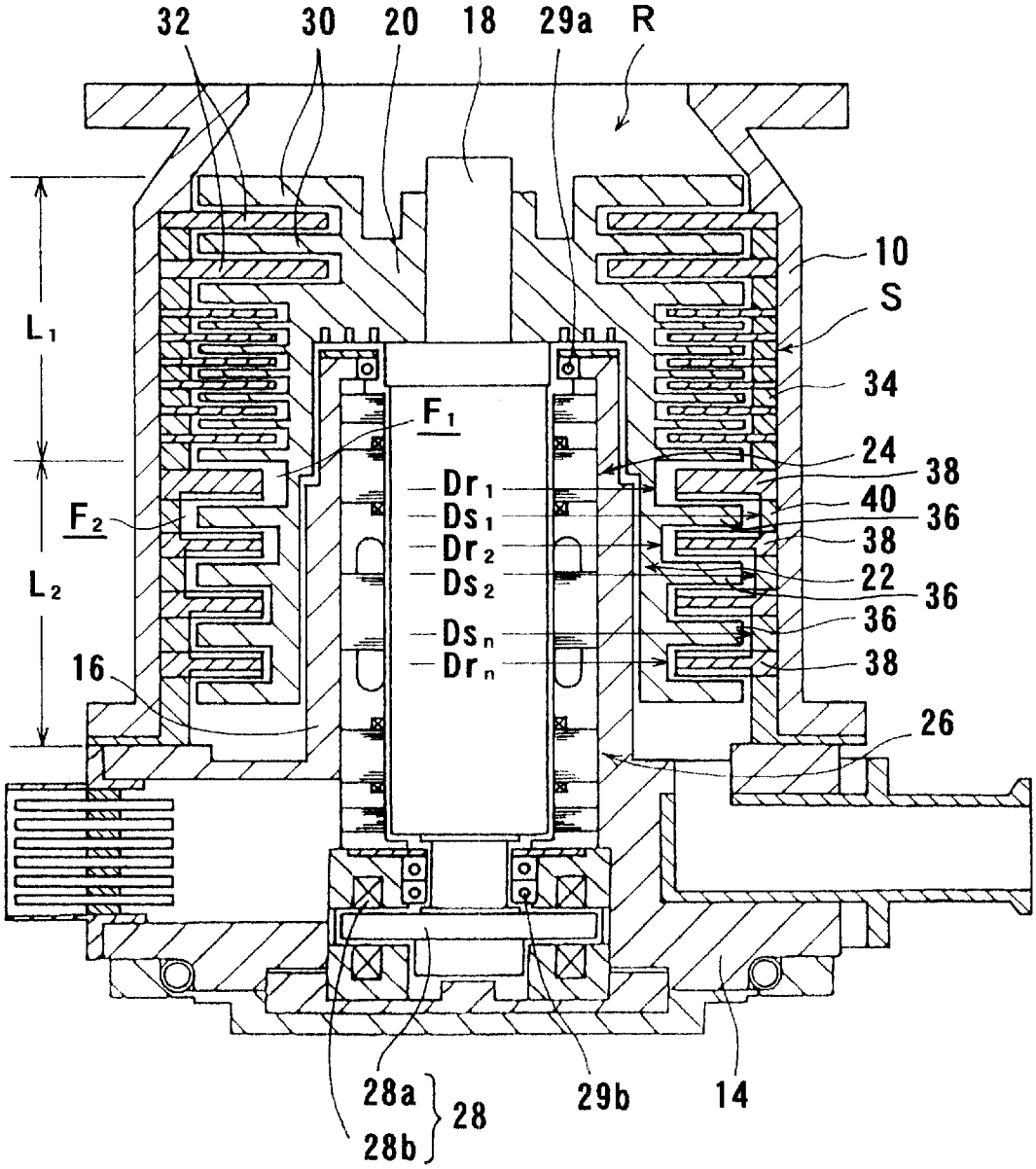
FIG. 3 is a cross-sectional view of a turbo-molecular pump according to a second embodiment of the present invention.
Figure 4:
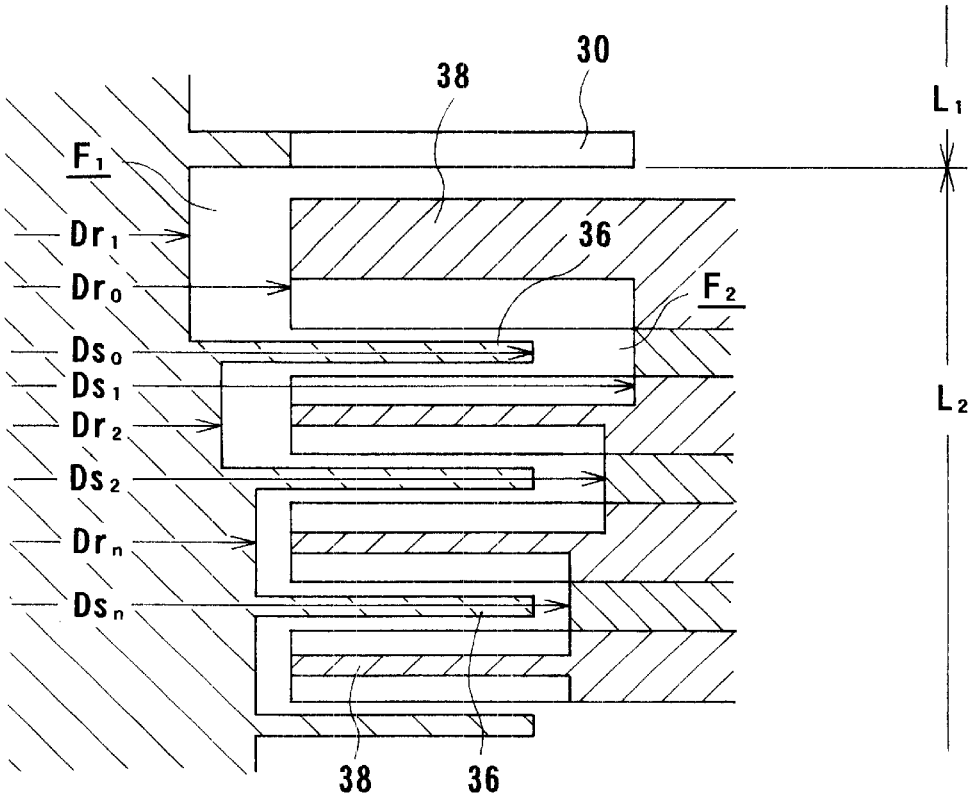
FIG. 4 is an essential part of the turbo-molecular pump shown in FIG. 3.

FIGS. 3 and 4 show a turbo-molecular pump according to a second embodiment of the present invention. In the present embodiment, in the radial turbine blade pumping section $L_2$, the outer diameter $Dr_1$ of the rotor at its portion facing the inner circumferential surface of the stator blade 38 at the first stage, the outer diameter $Dr_2$ of the rotor at its portion facing the inner circumferential surface of the stator blade 38 at the second stage, and the outer diameter $Dr_n$ of the rotor at its portion facing the inner circumferential surface of the stator blade 38 at other stages have the relationship of $Dr_1<Dr_2<Dr_n$. Further, the inner diameter $Ds_1$ of the stator (outer diameter of the spiral ridge-groove section) at its portion facing the outer circumferential surface of the rotor blade 36 at the first stage, the inner diameter $Ds_2$ of the stator (outer diameter of the spiral ridge-groove section) at its portion facing the outer circumferential surface of the rotor blade 36 at the second stage, and the inner diameter $Ds_n$ of the stator (outer diameter of the spiral ridge-groove portion) at its portion facing the outer circumferential surface of the rotor blade 36 at other stages have the relationship of $Ds_1>DS_2>Ds_n$. Other details of the turbo-molecular pump according to the second embodiment are identical to those of the conventional turbo-molecular pump shown in FIGS. 12 through 14.

According to the present embodiment, the cross-sectional area $S_1$ (see FIG. 5A) of the flow passage $F_1$ in an axial direction defined between the inner circumferential surface of the stator blade 38 at the first stage in the radial turbine blade pumping section $L_2$ and the outer circumferential surface of the rotor, and the cross-sectional area $S_2$ (see FIG. 5A) of the flow passage $F_2$ in an axial direction defined between the outer circumferential surface of the rotor blade 36 at the first stage in the radial turbine blade pumping section $L_2$ and the inner circumferential surface of the stator are enlarged for thereby guiding the gas smoothly toward a radial direction in flow passages upstream and downstream of the flow passage $F_1$ and the flow passage $F_2$.

Figure 5A:
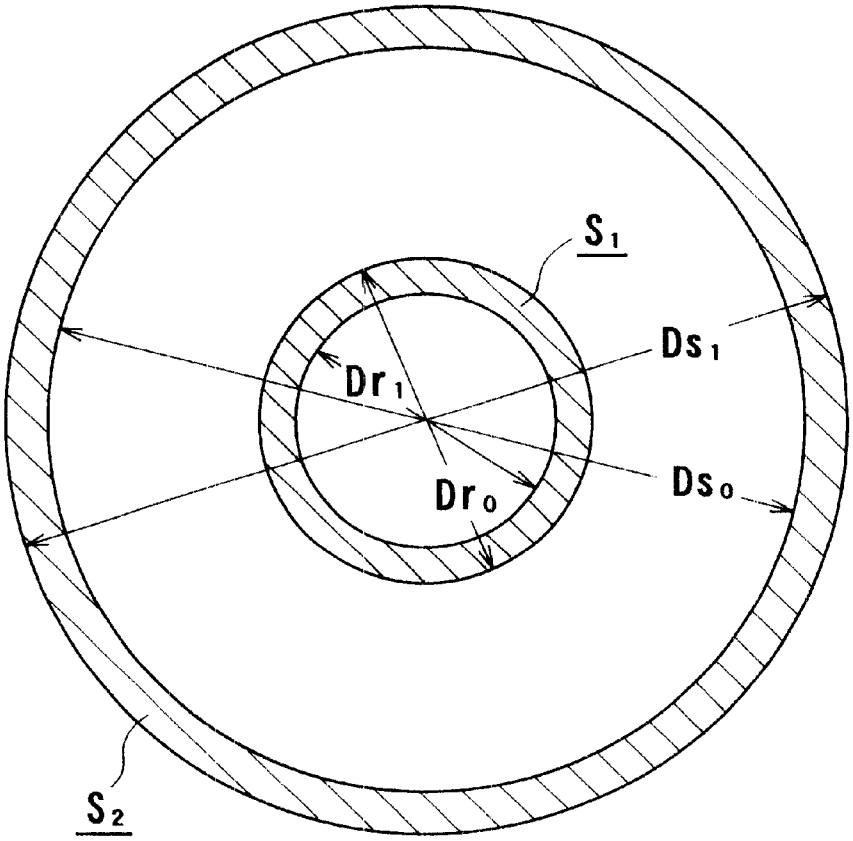
FIG. 5A is a horizontal cross-sectional view showing the cross-sectional area of flow passage in a portion around a stator blade and a rotor blade at a first stage of the turbo-molecular pump shown in FIG. 3.
Figure 5B:
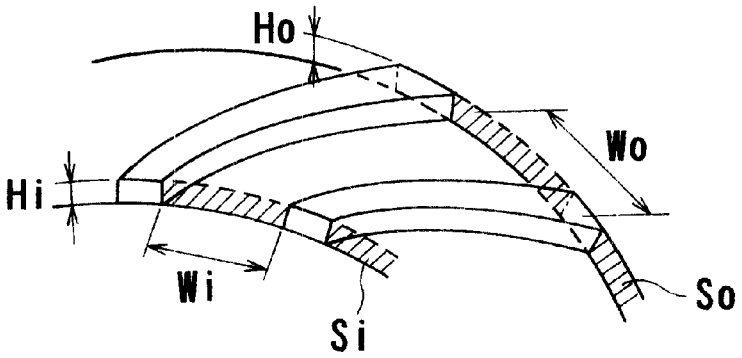
FIG. 5B is a perspective view showing a part of the flow passage shown in FIG. 5A.

Specifically, as shown in FIGS. 4, 5A and 5B, if the stator blade 38 has the inner diameter of $Dr_0$ and the rotor blade 36 has the outer diameter of $Ds_0$, then the above cross-sectional areas $S_1$ and $S_2$ are expressed by the following formulas:

$$S_1=\{(Dr_0/2)^2-(Dr_1/2)^2\}\cdot\pi.$$

$$S_2=\{(Ds_1/2)^2-(Ds_0/2)^2\}\cdot\pi.$$

On the other hand, in the case where the width of the flow passage defined by the spiral groove at the inner circumferential edge is $W_i$, the width of the flow passage defined by the spiral groove at the outer circumferential edge $W_0$, the hight of the flow passage defined by the spiral groove at the inner circumferential edge $H_i$, the hight of the flow passage defined by the spiral groove at the outer circumferential edge $H_0$, and the number of ridges J, the cross-sectional area $S_i$ of the flow passage at the inner circumferential edge and the cross-sectional area $S_0$ of the flow passage at the outer circumferential edge are expressed by the following formulas:

$$S_i=W_i\times H_i\times J$$

$$S_0=W_0\times H_0\times J$$

Therefore, the outer diameter $Dr_1$ of the rotor at its portion facing the inner circumferential surface of the stator blade 38 at the first stage and the inner diameter $Ds_1$ of the stator (outer diameter of the spiral ridge-groove section) at its portion facing the outer circumferential surface of the rotor blade 36 at the first stage are set to such dimensions that the cross-sectional area $S_1$ of the flow passage $F_1$ is equal to or larger than the cross-sectional area $S_i$ of the flow passage at the inner circumferential side, and the cross-sectional area $S_2$ of the flow passage $F_2$ is equal to or larger than the cross-sectional area $S_0$ of the flow passage at the outer circumferential side. Thus, the stagnation of gas flow in the radial turbine blade pumping section $L_2$ can be avoided.

If the shape of the spiral ridge-groove section on the front surface of the stator blade 38 is different from that on the backside surface of the stator blade 38, then the cross-sectional area $S_1$ of the flow passage $F_1$ is equal to or larger than the larger of the two cross-sectional areas $S_i$ at the inner circumferential side. If the shape of the spiral ridge-groove section on the backside surface of the stator blade 38 is different from that on the front surface of the stator blade 38 at the next stage, then the stagnation of the gas flow in the radial turbine blade pumping section $L_2$ can be avoided by allowing the cross-sectional area $S_2$ of the flow passage $F_2$ to be equal to or larger than the larger of the two cross-sectional areas $S_0$ at the outer circumferential side.

According to this embodiment, the outer diameters $Dr_1$, $Dr_2$ and $Dr_n$ of the rotor at their portions facing the inner circumferential surfaces of the stator blades 38 in the radial turbine blade pumping section $L_2$ have the relationship of $Dr_1<Dr_2<Dr_n$. However, if the number of stages is n, the following formula should hold:

$Dr_1 \leqq Dr_2 \leqq \ldots \leqq Dr_n$ (on condition that $Dr_1=Dr_2=\ldots=Dr_n$ is excepted therefrom)

Further, according to this embodiment, the inner diameters $Ds_1$, $Ds_2$ and $Ds_n$ of the stator at their portions facing the outer circumferential surfaces of the rotor blades 36 have the relationship of $Ds_1>Ds_2>Ds_n$. However, if the number of stages is n, the following formula should hold:

$Ds_1 \geqq Ds_2 \geqq \ldots \geqq Ds_n$ (on condition that $Ds_1=Ds_2=\ldots=Ds_n$ is excepted therefrom)

This relationship holds true for other embodiments of the present invention.

Figure 6:
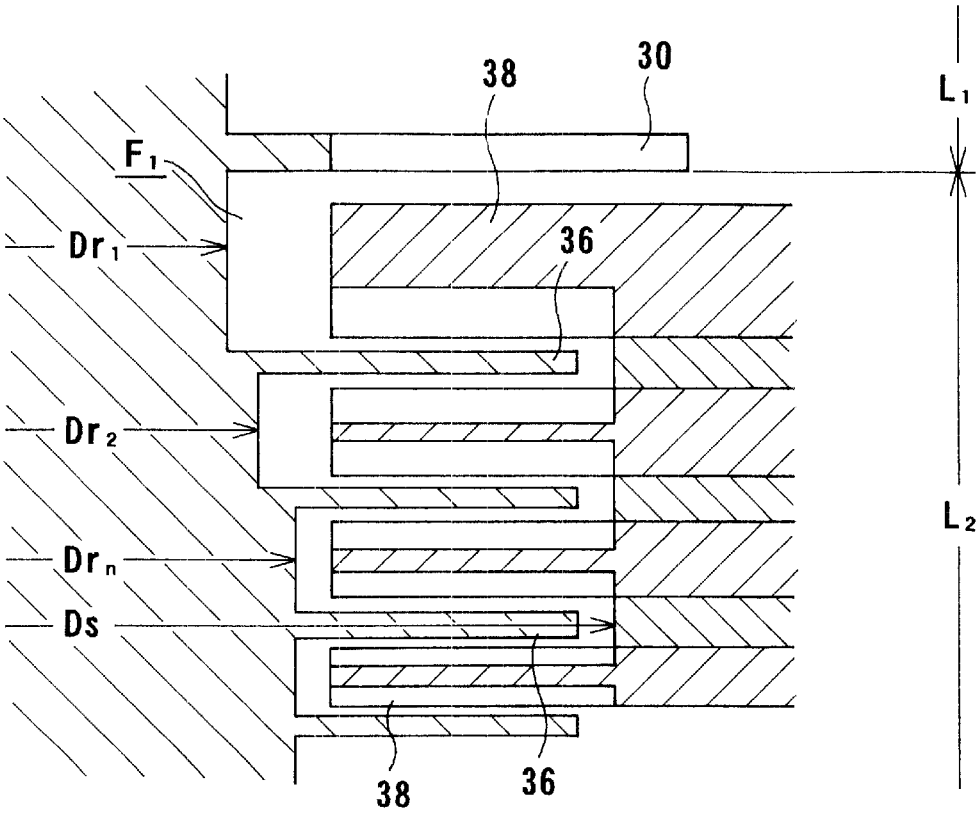
FIG. 6 is an enlarged view showing an essential part of a turbo-molecular pump according to a third embodiment of the present invention.

FIG. 6 shows a turbo-molecular pump according to a third embodiment of the present invention. According to the third embodiment, in the radial turbine blade pumping section $L_2$, the outer diameter $Dr_1$ of the rotor at its portion facing the inner circumferential surface of the stator blade 38 at the first stage, the outer diameter $Dr_2$ of the rotor at its portion facing the inner circumferential surface of the stator blade 38 at the second stage, and the outer diameter $Dr_n$ of the rotor at its portion facing the inner circumferential surface of the stator blade 38 at other stages have the relationship of $Dr_1<Dr_2<Dr_n$. Further, the inner diameter Ds of the stator (outer diameter of the spiral ridge-groove section) at its portion facing the outer circumferential surface of the rotor blade 36 at the first stage in the radial turbine blade pumping section $L_2$ is set to be equal in all stages.

With this arrangement, the cross-sectional area $S_1$ (see FIG. 5A) of the flow passage $F_1$ in an axial direction defined between the inner circumferential surface of the stator blade 38 at the first stage in the radial turbine blade pumping section $L_2$ and the outer circumferential surface of the rotor is enlarged for thereby guiding the gas smoothly toward a radial direction in flow passages upstream and downstream of the flow passage $F_1$.

Figure 7:
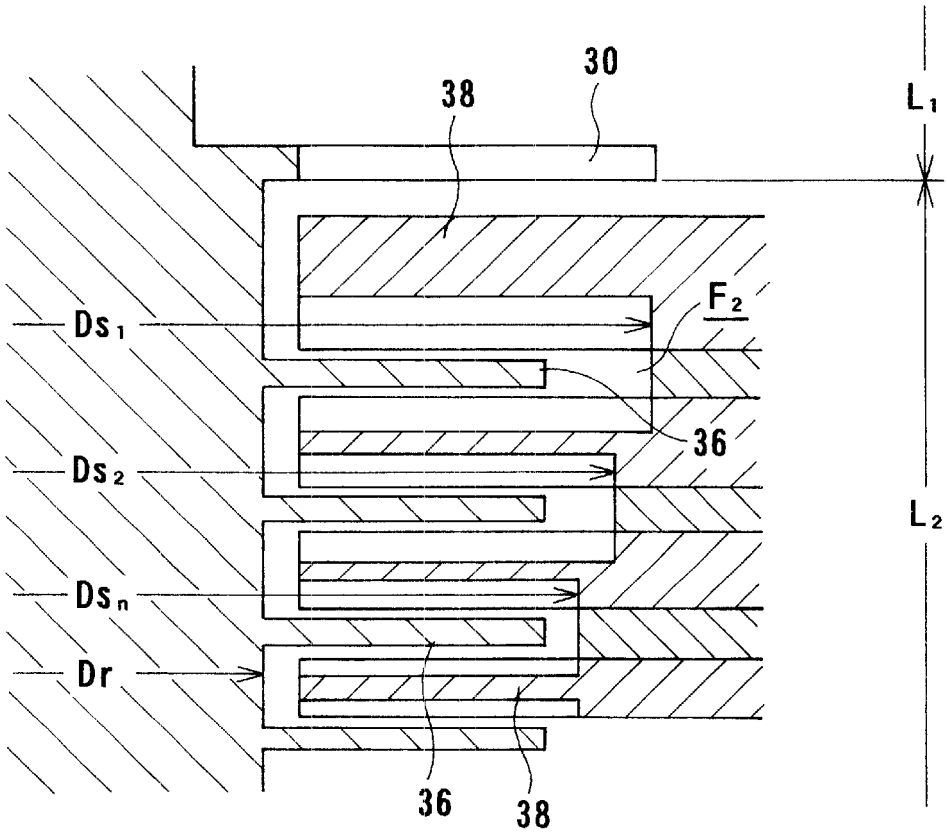
FIG. 7 is an enlarged view showing an essential part of a turbo-molecular pump according to a fourth embodiment of the present invention.

FIG. 7 shows a turbo-molecular pump according to a fourth embodiment of the present invention. According to the fourth embodiment, in the radial turbine blade pumping section $L_2$, the inner diameter $Ds_1$ of the stator (outer diameter of the spiral ridge-groove section) at its portion facing the outer circumferential surface of the rotor blade 36 at the first stage, the inner diameter $Ds_2$ of the stator (outer diameter of the spiral ridge-groove section) at its portion facing the outer circumferential surface of the rotor blade 36 at the second stage, and the inner diameter $Ds_n$ of the stator (outer diameter of the spiral ridge-groove section) at its portion facing the outer circumferential surface of the rotor blade 36 at other stages have the relationship of $Ds_1>Ds_2>Ds_n$. Further, the outer diameter Dr of the rotor at its portion facing the inner circumferential surface of the stator blade 38 at the first stage in the radial turbine blade pumping section $L_2$ is set to be equal in all stages.

With this arrangement, the cross-sectional area $S_2$ of the flow passage $F_2$ (see FIG. 5A) in an axial direction defined between the outer circumferential surface of the rotor blade 36 at the first stage in the radial turbine blade pumping section $L_2$ and the inner circumferential surface of the stator is enlarged for thereby guiding the gas smoothly toward a radial direction in flow passages upstream and downstream of the flow passage $F_2$.

Figure 8:
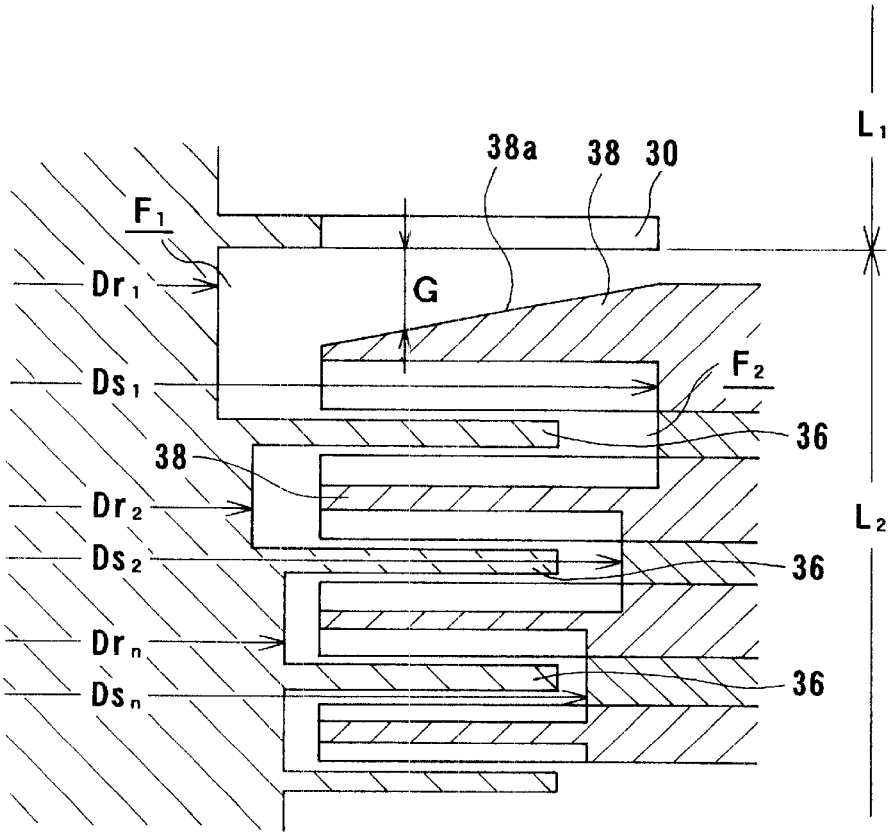
FIG. 8 is an enlarged view showing an essential part of a turbo-molecular pump according to a fifth embodiment of the present invention.

FIG. 8 shows a turbo-molecular pump according to a fifth embodiment of the present invention. The turbo-molecular pump according to the fifth embodiment incorporates the features of the turbo-molecular pump according to the first embodiment and the features of the turbo-molecular pump according to the second embodiment. More specifically, the stator blade 38 at the first stage in the radial turbine blade pumping section $L_2$ has a tapered surface 38*a* which is gradually inclined downwardly in a radially inward direction to make the stator blade 38 gradually smaller in thickness so that the gap G between this first-stage stator blade 38 and the rotor blade 30 located immediately above the first-stage stator blade 38 and at the lowermost stage in the axial turbine blade pumping section $L_1$ is gradually larger toward the inner circumferential side of the stator blade 38. Further, in the radial turbine blade pumping section $L_2$, the outer diameter $Dr_1$ of the rotor at its portion facing the inner circumferential surface of the stator blade 38 at the first stage, the outer diameter $Dr_2$ of the rotor at its portion facing the inner circumferential surface of the stator blade 38 at the second stage, and the outer diameter $Dr_n$ of the rotor at its portion facing the inner circumferential surface of the stator blade 38 at other stages have the relationship of $Dr_1<Dr_2<Dr_n$. Further, the inner diameter $Ds_1$ of the stator (outer diameter of the spiral ridge-groove section) at its portion facing the outer circumferential surface of the rotor blade 36 at the first stage, the inner diameter $Ds_2$ of the stator (outer diameter of the spiral ridge-groove section) at its portion facing the outer circumferential surface of the rotor blade 36 at the second stage, and the inner diameter $Ds_n$ of the stator (outer diameter of the spiral ridge-groove section) at its portion facing the outer circumferential surface of the rotor blade 36 at other stages have the relationship of $Ds_1>Ds_2>Ds_n$. With this arrangement, the turbo-molecular pump according to the fifth embodiment can obtain the synergistic effect of the turbo-molecular pumps according to the first and the second embodiments.

Figure 9:
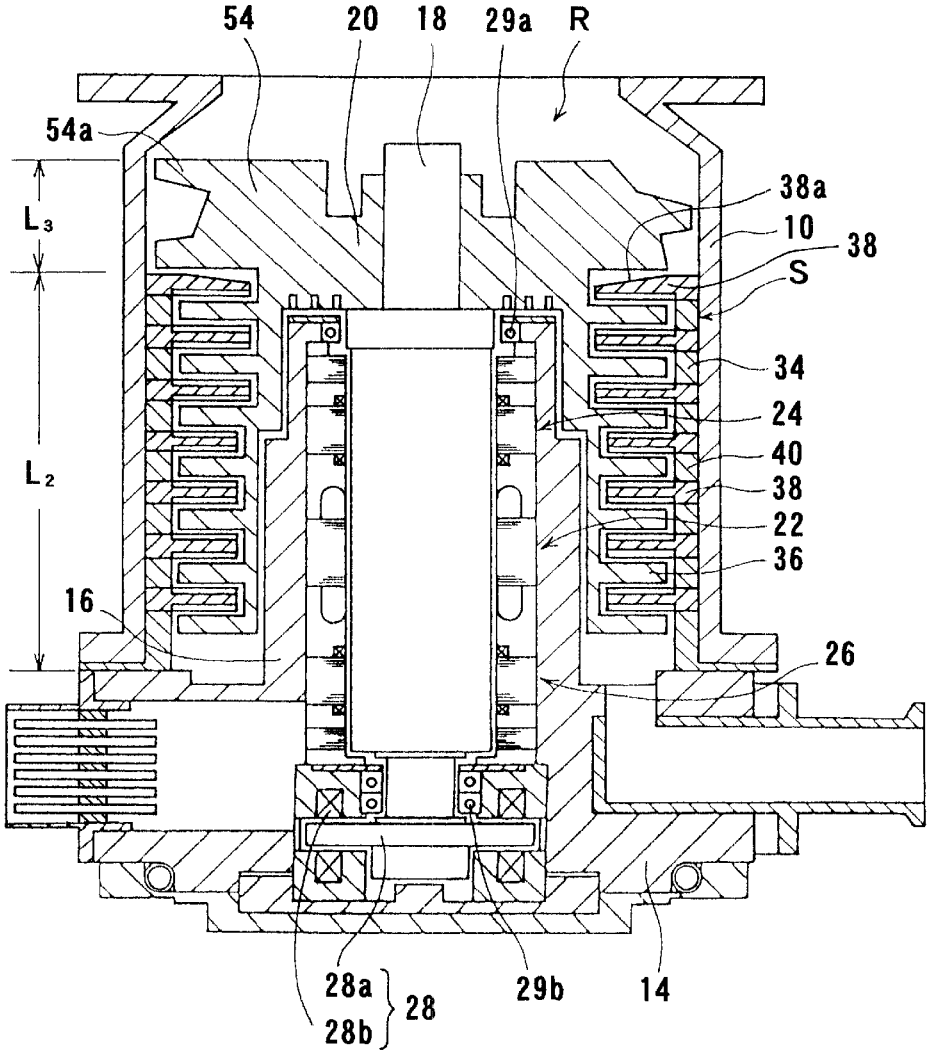
FIG. 9 is a cross-sectional view of a turbo-molecular pump according to a sixth embodiment of the present invention.

FIG. 9 shows a turbo-molecular pump according to a sixth embodiment of the present invention. In this embodiment, a turbo-molecular pump has an axial thread groove pumping section $L_3$ comprising cylindrical thread grooves and a radial turbine blade pumping section $L_2$ at the upper and lower sides thereof. Specifically, in this turbo-molecular pump, the rotor body 20 has a cylindrical thread groove section 54 having thread grooves 54*a*, and the thread groove section 54 and the casing 10 jointly make up the axial thread groove pumping section $L_3$ for evacuating gas by way of a dragging action of the thread grooves in the rotor R which rotates at a high speed. In the radial turbine blade pumping section $L_2$, the stator blade 38 at the first stage has a tapered surface 38*a* which is gradually inclined downwardly in a radially inward direction to make the stator blade 38 gradually smaller in thickness.

According to this embodiment, the axial thread groove pumping section $L_3$ comprising the cylindrical thread grooves functions effectively in the pressure range of 1 to 1000 Pa, and hence this turbo-molecular pump can be operated in the viscous flow range close to the atmosphere although the ultimate vacuum is low.

Figure 10:
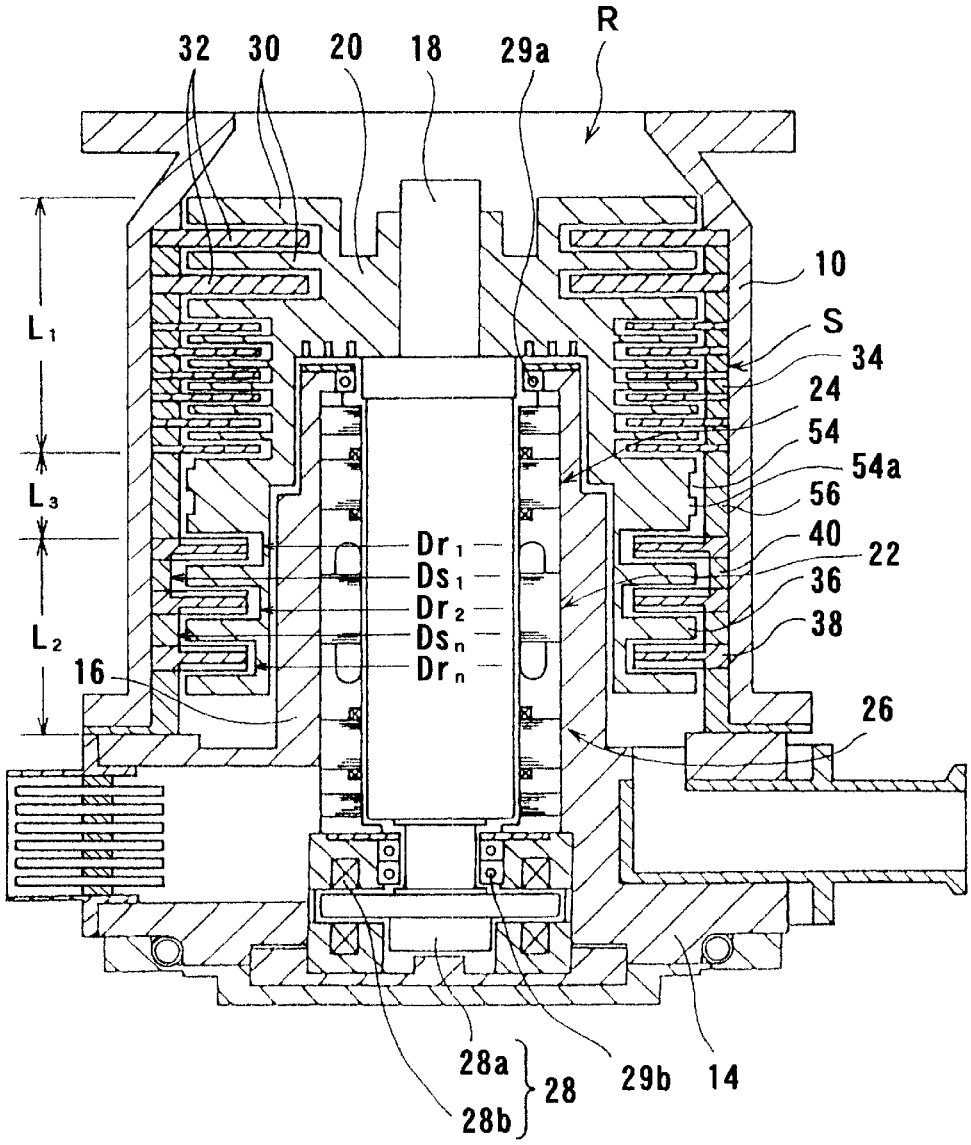
FIG. 10 is a cross-sectional view of a turbo-molecular pump according to a seventh embodiment of the present invention.

FIG. 10 shows a turbo-molecular pump according to a seventh embodiment of the present invention. In the seventh embodiment, a turbo-molecular pump has an axial thread groove pumping section $L_3$ comprising cylindrical thread grooves between the axial turbine blade pumping section $L_1$ and the radial turbine blade pumping section $L_2$ which comprise a turbine blade section. Specifically, the rotor body 20 has a thread groove section 54 having thread grooves 54*a* formed in an outer circumferential surface thereof at its intermediate portion, and the thread groove section 54 is surrounded by a thread groove pumping section spacer 56, thereby constituting the axial thread groove pumping section $L_3$ for evacuating gas molecules by way of a dragging action of the thread grooves in the rotor R which rotates at a high speed. In the radial turbine blade pumping section $L_2$, the outer diameter $Dr_1$ of the rotor at its portion facing the inner circumferential surface of the stator blade 38 at the first stage, the outer diameter $Dr_2$ of the rotor at its portion facing the inner circumferential surface of the stator blade 38 at the second stage, and the outer diameter $Dr_n$ of the rotor at its portion facing the inner circumferential surface of the stator blade 38 at other stages have the relationship of $Dr_1<Dr_2<Dr_n$. Further, the inner diameter $Ds_1$ of the stator at its portion facing the outer circumferential surface of the rotor blade 36 at the first stage in the radial turbine blade pumping section $L_2$, and the inner diameter $Ds_n$ of the stator at its portion facing the outer circumferential surface of the rotor blade 36 at other stages have the relationship of $Ds_1>Ds_n$. According to this embodiment, three-stage pumping structure is constructed to thus improve pumping speed of the turbo-molecular pump.

Figure 11:
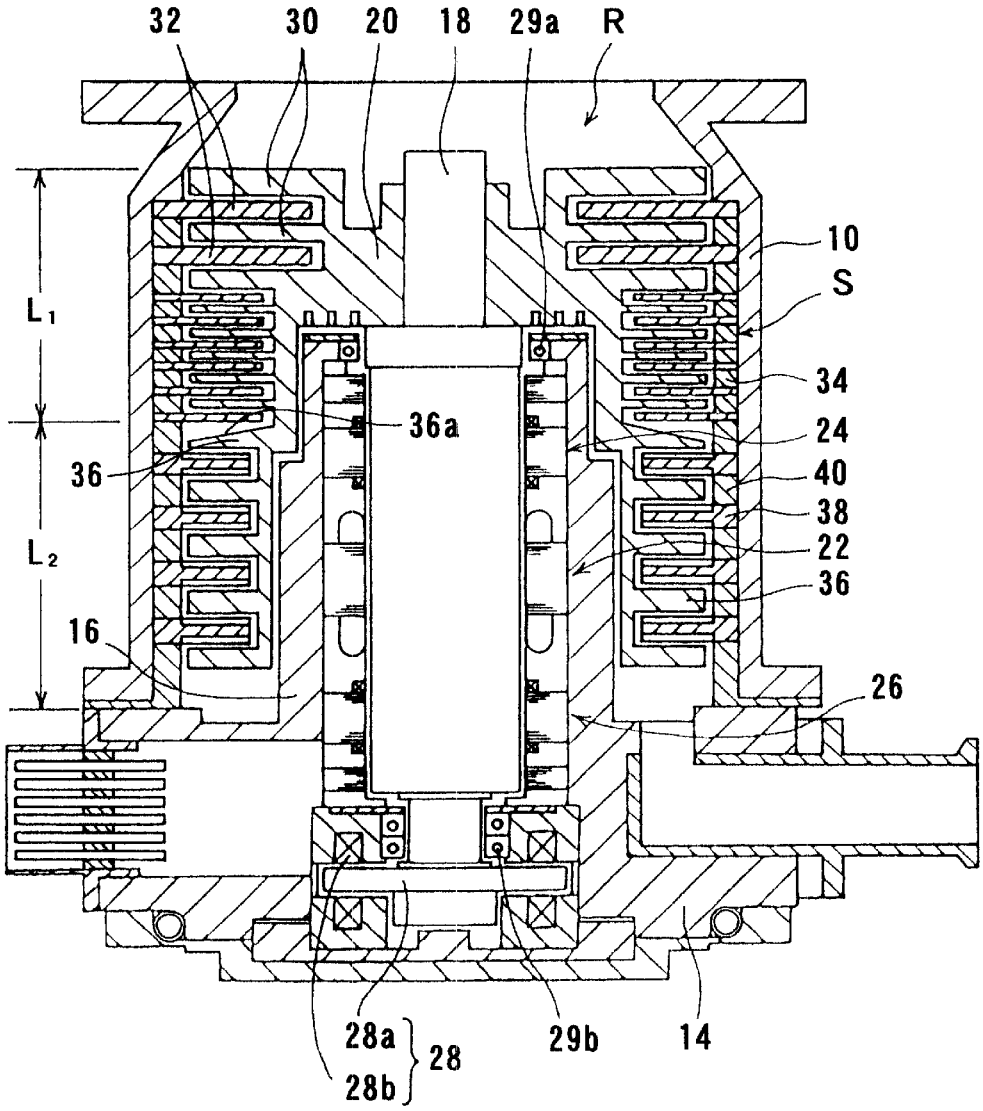
FIG. 11 is a cross-sectional view of a turbo-molecular pump according to an eighth embodiment of the present invention.

FIG. 11 shows a turbo-molecular pump according to an eighth embodiment of the present invention. According to the eighth embodiment, a turbo-molecular pump has an axial turbine blade pumping section $L_1$ and a radial turbine blade pumping section $L_2$ which comprise a turbine blade section shown in FIGS. 12 through 14. As shown in FIG. 11, the rotor blade 36 at the first stage in the radial turbine blade pumping section $L_2$ has a tapered surface 36*a* which is gradually inclined downwardly in a radially outward direction to make the rotor blade 36 gradually smaller in thickness so that the gap between the first-stage rotor blade 36 and the stator blade 32 located immediately above the first-stage rotor blade 36 and at the lowermost stage in the axial turbine blade pumping section $L_1$ is gradually larger toward the outer circumferential side of the rotor blade 36, i.e. the outer circumferential side of the radial turbine blade pumping section $L_2$. Other details of the turbo-molecular pump according to the present embodiment are identical to those of the conventional turbo-molecular pump shown in FIGS. 12 through 14.

According to the present embodiment, the gas flowing from the axial turbine blade pumping section $L_1$ to the radial turbine blade pumping section $L_2$ can be guided smoothly toward the outer circumferential side of the radial turbine blade pumping section $L_2$.

As described above, according to the above embodiments, the turbo-molecular pumps have the radial turbine blade pumping section, and the axial pumping section comprising turbine blades or thread grooves. However, the principles of the present invention are also applicable to a turbo-molecular pump having only the radial turbine blade pumping section. Further, the combination of the radial turbine blade pumping section and the axial pumping section is not limited to the above embodiments. Furthermore, although the spiral ridge-groove sections are formed in the stator blades of the stator in the embodiments, the spiral ridge-groove sections may be provided on the rotor blades of the rotor, or both of the stator blades of the stator and the rotor blades of the rotor.

As described above, according to the present invention, the gas flowing from an axial direction to a radial direction can be smoothly guided, and the stagnation of the gas flow in the radial turbine blade pumping section can be avoided for thereby allowing the gas to flow smoothly and preventing evacuation performance from being lowered.

Although certain preferred embodiments of the present invention have been shown and described in detail, it should be understood that various changes and modifications may be made therein without departing from the scope of the appended claims.

What is claimed is:

1. A turbo-molecular pump comprising:

a casing;

a stator fixedly mounted in said casing and having stator blades;

a rotor rotatably provided in said casing and having rotor blades, said rotor blades alternating with said stator blades; and a radial turbine blade pumping section having a spiral ridge-groove section provided on at least one of surfaces, facing each other, of said stator blade and said rotor blade;

wherein at least one of said stator blade and said rotor blade which are located at a first stage of said radial turbine blade pumping section has such a shape that said at least one of said stator blade and said rotor blade having a region of reduce thickness in a direction of gas flow.

2. A turbo-molecular pump according to claim 1, wherein said at least one of said stator blade and said rotor blade located at said first stage has such a shape as to be thinner in a tapered manner or a step-like manner.

3. A turbo-molecular pump comprising:

a casing;

a stator fixedly mounted in said casing and having stator blades;

a rotor rotatably provided in said casing and having rotor blades, said rotor blades alternating with said stator blades; and a radial turbine blade pumping section having a spiral ridge-groove section provided on at least one of surfaces, facing each other, of said stator blade and said rotor blade;

wherein an outer diameter of said rotor at its portion facing an inner circumferential surface of a stator blade at a first stage in said radial turbine blade pumping section is smaller than an outer diameter of said rotor at its portion facing an inner circumferential surface of a stator blade at any one of stages subsequent to said first stage.

4. A turbo-molecular pump according to claim 3, wherein at least one of said stator blade and said rotor blade which are located at said first stage has such a shape that said at least one of said stator blade and said rotor blade is smaller in thickness in a direction of gas flow.

5. A turbo-molecular pump comprising:

a casing;

a stator fixedly mounted in said casing and having stator blades;

a rotor rotatably provided in said casing and having rotor blades, said rotor blades alternating with said stator blades; and a radial turbine blade pumping section having a spiral ridge-groove section provided on at least one of surfaces, facing each other, of said stator blade and said rotor blade;

wherein one of an inner diameter of said stator and an outer diameter of said spiral ridge-groove section at its portion facing an outer circumferential surface of a rotor blade at a first stage in said radial turbine blade pumping section is larger than an inner diameter of said stator and an outer diameter of said spiral ridge-groove section at its portion facing an outer circumferential surface of a rotor blade at any one of stages subsequent to said first stage.

6. A turbo-molecular pump according to claim 5, wherein at least one of said stator blade and said rotor blade which are located at said first stage has such a shape that said at least one of said stator blade and said rotor blade is smaller in thickness in a direction of gas flow.

7. A turbo-molecular pump comprising:

a casing;

a stator fixedly mounted in said casing and having stator blades;

a rotor rotatably provided in said casing and having rotor blades, said rotor blades alternating with said stator blades; and a radial turbine blade pumping section having a spiral ridge-groove section provided on at least one of surfaces, facing each other, of said stator blade and said rotor blade;

wherein an outer diameter of said rotor at its portion facing an inner circumferential surface of a stator blade at a first stage in said radial turbine blade pumping section is smaller than an outer diameter of said rotor at its portion facing an inner circumferential surface of a stator blade at any one of stages subsequent to said first stage; and one of an inner diameter of said stator and an outer diameter of said spiral ridge-groove section at its portion facing an outer circumferential surface of a rotor blade at a first stage in said radial turbine blade pumping section is larger than an inner diameter of said stator and an outer diameter of said spiral ridge-groove section at its portion facing an outer circumferential surface of a rotor blade at any one of stages subsequent to said first stage.

8. A turbo-molecular pump according to claim 7, wherein at least one of said stator blade and said rotor blade which are located at said first stage has such a shape that said at least one of said stator blade and said rotor blade is smaller in thickness in a direction of gas flow.

* * * * *